US008874019B2

(12) United States Patent
Fujisaki et al.

(10) Patent No.: US 8,874,019 B2
(45) Date of Patent: Oct. 28, 2014

(54) IMAGE FORMING METHOD

(71) Applicants: Natsuko Fujisaki, Tokyo (JP); Hiroaki Obata, Tokyo (JP); Koji Shibata, Tokyo (JP); Anju Hori, Tokyo (JP); Kishio Tamura, Tokyo (JP)

(72) Inventors: Natsuko Fujisaki, Tokyo (JP); Hiroaki Obata, Tokyo (JP); Koji Shibata, Tokyo (JP); Anju Hori, Tokyo (JP); Kishio Tamura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 102 days.

(21) Appl. No.: 13/751,278

(22) Filed: Jan. 28, 2013

(65) Prior Publication Data

US 2013/0202336 A1 Aug. 8, 2013

(30) Foreign Application Priority Data

Feb. 2, 2012 (JP) ..... 2012-020613
Mar. 29, 2012 (JP) ..... 2012-075826

(51) Int. Cl.

| | |
|---|---|
| ***G03G 15/20*** | (2006.01) |
| ***G03G 13/20*** | (2006.01) |
| ***G03G 11/00*** | (2006.01) |
| *G03G 15/01* | (2006.01) |

(52) U.S. Cl.

CPC ..... *G03G 13/20* (2013.01); *G03G 15/0189* (2013.01); *G03G 15/2096* (2013.01); *G03G 11/00* (2013.01); *G03G 2215/2074* (2013.01)
USPC ..... 399/340

(58) Field of Classification Search

CPC ... G03G 13/20; G03G 11/00; G03G 15/0189; G03G 15/2096; G03G 2215/2074
USPC ..... 399/340
See application file for complete search history.

(56) References Cited

U.S. PATENT DOCUMENTS 7,655,374 B2 * 2/2010 Katano et al. ..... 430/124.1
8,737,899 B2 * 5/2014 Katano et al. ..... 399/340

FOREIGN PATENT DOCUMENTS

| | | |
|---|---|---|
| JP | 3290513 | 3/2002 |
| JP | 4302700 | 5/2009 |
| JP | 4358896 | 8/2009 |
| JP | 2011-128457 | 6/2011 |

* cited by examiner

*Primary Examiner* — Hoang Ngo
(74) *Attorney, Agent, or Firm* — Lucas & Mercanti, LLP

(57) ABSTRACT

In an image forming method of wet fixing system, the fixing solution contains an ester compound represented by at least one of general formula (1) and general formula (2) below:

$R^{11}$—(CO)—O—$R^{12}$ General formula (1):

where $R^{11}$ represents a linear or branched alkyl group having at least one hydroxyl group and 2 to 11 carbon atoms, and $R^{12}$ represents a linear or branched alkyl group having 1 to 4 carbon atoms;

$R^{21}$—O—(CO)—$R^{22}$—(CO)—O—$R^{23}$ General formula (2):

where $R^{21}$ represents a linear or branched aliphatic hydrocarbon group having 1 to 4 carbon atoms, $R^{22}$ represents a linear or branched aliphatic hydrocarbon group having at least one hydroxyl group and 1 to 8 carbon atoms, and $R^{23}$ represents a linear or branched aliphatic hydrocarbon group having 1 to 4 carbon atoms.

19 Claims, 2 Drawing Sheets

IMAGE FORMING METHOD

This Application claims the priority of Japanese Application No. JP 2012-020613 filed on Feb. 2, 2012 which, in turn, claims the priority of JP 2012-075826 filed on Mar. 29, 2012, both Applications are incorporated herein by reference.

BACKGROUND Of THE INVENTION

1. Field of the Invention

The present invention relates to an image forming method of a wet fixing system using an electrophotographic system.

2. Description of the Related Art

An image forming device such as a printer, a facsimile machine or a copying machine is a device that forms an image including characters and symbols on an image support such as paper, cloth or an OHP sheet based on image information.

In particular, the linage forming devices of an electrophotographic system are widely utilized in, for example, offices because it is possible to form a nigh minute image on a plain paper at high speed. In the image forming device of the electrophotographic system described above, there is widely used a thermal fixing system in which the toner constituting a toner image on an image support is heated and melted, the molten toner is pressurized, and thus the toner image is fixed on the image support. With this thermal fixing system, it is possible to provide a high filing rate and a high image quality.

However, in the image forming device of the thermal fixing system described above, about more than half of consumption power is consumed to heat the toner. In contrast, from the viewpoint of measures against environmental issues in recent years, there has been desired a fixing method in which lower power consumption (energy saving) is ensured. That is, it is desirable to use a fixing method in which the temperature at which the toner is heated to be fixed is extremely lowered compared with in the past or in which heating of the toner is not necessary. In particular, a non-heating fixing system in which a toner image is fixed on an image support without a toner being heated is ideal in terms of low power consumption.

As the non-heating fixing system, a wet fixing system is known in which a fixing solution for softening a toner is supplied to a toner image to thereby fix it on an image support. However, there are a few problems in the wet fixing system.

For example, when in order for a high fixing strength to be obtained, a large amount of fixing solution is coated on an image support such as paper, a problem exists in which, the toner particles constituting a toner image are moved on the image support by the excessive amount of fixing solution to thereby degrade the image quality, and a problem exists in which drying time is elongated, which degrades the fixing responsiveness (see Patent Literature 1 and 2). Furthermore, a problem exists in which a remarkable feeling of liquid left in paper (a wet feeling when paper is touched with hands) is produced.

Moreover, for example, when, as a fixing solution, an oil droplet water solution-type fixing solution is used in which an organic compound insoluble or poorly soluble in water is dispersed and mixed with water, if a large amount of fixing solution is supplied, an image support such as paper absorbs water in the fixing solution, and thus a crease or a curl is generated on the image support. This causes a problem of reducing the stable and high-speed transport properties of the linage support which is required in the image forming device (see Patent Literature 3).

As to the fixing responsiveness, when the rate at which the fixing solution is softened for the toner is low, it is necessary to decrease the image processing rate of the image forming device, and thus there is a problem in which an image processing capacity that the image forming device originally has cannot be achieved. In particular, when linage formation using a color toner is performed, toner particles of different colors are stacked to increase the thickness, and thus it is necessary to increase the rate at which the fixing solution is softened for the toner (see Patent Literature 4).

As described above, in the fixing solution used in the wet fixing system, higher fixing rate and higher drying rate are required to be achieved while the supply amount of fixing solution is reduced and excellent fixing performances such as reducing a wet feeling in a formed image and having a high fixing strength are required.

CITATION LIST

Patent Literature

[Patent Literature 1] Japanese Patent No. 4302700

[Patent Literature 2] Japanese Patent No. 4358696

[Patent Literature 3] Japanese Patent No. 3290513

[Patent Literature 4] Japanese Patent Application Laid-Open No. 2011-128457

SUMMARY OF THE INVENTION

Technical Problems

The present invention has been made on the basis of the forgoing conditions, and an object of the present invention is to provide an image forming method in which higher fixing rate and higher drying rate are achieved while the supply amount of fixing solution is reduced and in which a wet feeling is reduced in a formed image and a high fixing strength is obtained.

Means to Solve the Problems

To achieve the abovementioned object, an image forming method reflecting one aspect of the present invention including: an electrostatic latent image formation step of forming an electrostatic latent image on an electrostatic latent image carrier; a development step of forming a toner image by developing the electrostatic latent image with a dry developer including a toner; a transfer step of transferring the toner image to an image support; and a fixing solution supply step of supplying, to the toner image transferred to the image support, a fixing solution that softens the toner, in which the fixing solution contains an ester compound represented by at least one of general formula (1) and general formula (2) below.

$$R^{11}—(CO)—O—R^{12}$$ General formula (1):

where $R^{11}$ represents a linear or branched alkyl group having at least one hydroxyl group and 2 to 11 carbon atoms, and $R^{12}$ represents a linear or branched alkyl group having 1 to 4 carbon atoms.

$$R^{21}—O—(CO)—R^{22}—(CO)—O—R^{23}$$ General formula (2):

where $R^{21}$ represents a linear or branched aliphatic hydrocarbon group having 1 to 4 carbon atoms, $R^{22}$ represents a linear or branched aliphatic hydrocarbon group having at least one hydroxyl group and 1 to 8 carbon atoms and $R^{23}$ represents a linear or branched aliphatic hydrocarbon group having 1 to 4 carbon atoms.

Preferably, in the image forming method of present invention, the ester compound represented by the general formula (1) is at least one selected from ethyl lactate, isoamyl lactate, 3-hydroxybutyric acid ethyl ester, 2-hydroxybutyric acid ethyl ester, 2-hydroxyisobutyric acid methyl ester, 3-hydroxyvaleric acid ethyl ester, 2-hydroxyvaleric acid ethyl ester, 2-hydroxy-4-metyl valeric acid ethyl ester, 3-hydroxyhexane acid ethyl ester, 2-hydroxyhexane acid ethyl ester, 5-hydroxyhexane acid, ethyl ester, 3-hydroxyoctanoic acid, ethyl ester and 5-hydroxyoctanoic acid ethyl ester.

Furthermore, preferably, the ester compound represented by the general formula (1) has, in $R^{11}$ of the general formula (1), a hydroxyl group at β position to a carbonyl group.

Moreover, preferably, the ester compound represented by the general formula (1) is 3-hydroxyhexane acid ethyl ester.

Preferably, in the image forming method of the present invention, the ester compound represented by the general formula (2) is at least one selected from 2-hydroxy malonic acid diethyl ester, 2-hydroxy malonic acid diisopropyl ester, diethyl malate (2-hydroxy succinic acid diethyl ester), dibutyl malate (2-hydroxy succinic acid dibutyl ester), 3-hydroxy glutaric acid, diethyl ester (3-hydroxy pentanedioic acid diethyl ester), 2-hydroxy glutaric acid diethyl ester (2-hydroxy pentanedioic acid diethyl ester), 2-hydroxy adipic acid diethyl ester (2-hydroxy hexanedioic acid diethyl ester), 3-hydroxy adipic acid diethyl ester (3-hydroxy hexanedioic acid diethyl ester), 2-hydroxy octanedioic acid diethyl ester and 3-hydroxy octanedioic acid diethyl ester.

Furthermore, preferably, the ester compound represented by the general formula (2) has, in $R^{22}$ of the general formula (2), a hydroxyl group at β position to a carbonyl group.

Moreover, preferably, the ester compound represented by the general formula (2) is 3-hydroxy glutaric acid diethyl ester.

In the image forming method of the present invention, the fixing solution further preferably contains a diluent and a surfactant.

In the image forming method of the present invention, the ester compound represented by at least one of the general formula (1) and the general formula (2) is preferably contained at a rate of 1 to 30 mass % to the fixing solution.

In the image forming method of the present invention, the toner includes preferably toner particles containing a polyester resin as a binder resin.

In the image forming method of the present invention, a particle diameter of the toner is preferably 3.5 to 7.0 μm as a volume-based median diameter, and more preferably 5.0 to 6.5 μm.

In the image forming method of the present invention, an average degree of circularity of the toner is preferably 0.950 to 0.995.

In the image forming method of the present invention, a glass transition temperature of the toner is preferably 35 to 50° C.

In the image forming method of the present invention, a content of the surfactant is preferably contained at a rate of 1 to 5 mass % to the fixing solution.

In the image forming method of the present invention, a supply amount of the fixing solution is preferably 0.4 g or less per image support of A4-size, and is more preferably 0.1 g or less per image support of A4-size.

Preferably, in the image forming method of the present invention, as a method of supplying the fixing solution, fixing solution supply means including a line-type inkjet nozzle is used.

Preferably, a size of a droplet of the fixing solution discharged from the inkjet nozzle is 0.5 to 50 pl.

Advantageous Effects of Invention

According to the image forming method of the present invention, a fixing solution contains an ester compound (hereinafter referred to as a "specific ester compound") represented by at least one of general formula (1) and general formula (2), and thus higher fixing rate and higher drying rate sire realized while the supply amount of fixing solution is reduced, and a wet feeling is reduced on a formed image and a nigh fixing strength is obtained.

DESCRIPTION OF THE EMBODIMENTS

Figure 1:
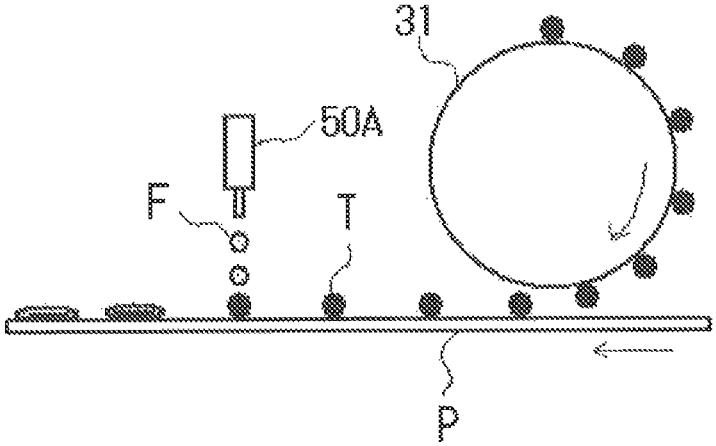
FIG. 1 is an illustrative cross-sectional view showing an example of the configuration of fixing solution supply means used in an image forming method of the present invention.

The present invention will be described in detail below.

[Fixing Solution]

A fixing solution used in an image forming method of a wet fixing system of the present invention, by dissolving or swelling and thereby softening at least a part of a binder resin contained in the toner particles that constitute a toner, is for fixing the toner image constituted by the toner to an image support, and contains a specific ester compound as a softener.

The fixing solution of the present invention, as an essential component, may contain a diluent such as water, and as necessary, may contain another component such as a dispersing agent.

(Specific Ester Compound)

The fixing solution used in the image forming method of the present invention contain, as a softener, an ester compound represented by at least one of general formula (1) and general formula (2) described above.

By the fixing solution described above containing the specific ester compound as a softener, when the fixing solution is supplied to the toner image, it is considered that an ester bond (group) within the molecule of the specific ester compound and the toner molecule are intermolecularly hydrogen-bonded to each other, to thereby have an affinity and soften the toner particles, and a hydroxyl group within the molecule of the specific ester compound and the toner molecule are also intermolecularly hydrogen-bonded to each other, to thereby facilitate the softening of the toner particles. Moreover, it is considered that the toner particles that are softened, as a result of the hydroxyl group within the molecule of the specific ester compound being intermolecularly hydrogen-bonded to the molecule of the fiber cellulose of the image support such as paper are adsorbed to paper fiber, and thus a high adhesion can be obtained. That is, since it is considered that these hydrogen bonds probably produce effects on the "softening of the toner particles" and "affinity for paper (adhesion)," in the image forming method according to the present invention, through the use of the fixing solution, faster fixing rate and faster drying rate are realized while the supply amount of fixing solution being reduced, and also a wet feeling is reduced in a formed image and a high fixing strength is achieved. Note that the mechanism of the softening of the toner particles with the hydroxyl group is considered to be the same as the mechanism (solvation) of the dissolving the toner resin with, for example, a low molecular alcohol and THF (tetrahydrofuran).

(Ester Compound Represented by General Formula (1))

The ester compound constituting the fixing solution represented by general formula (1) is an ester compound (hydroxyalkanoate) of a hydroxycarboxylic acid that is obtained by the dehydration condensation reaction of a carboxylic acid having a hydroxyl group and an alcohol.

In general formula (1), $R^{11}$ represents a linear or branched alkyl group having at least one hydroxyl group and 2 to 11 carbon atoms. In $R^{11}$, the number of carbon atoms is preferably 5.

$R^{12}$ represents a linear or branched alkyl group having 1 to 4 carbon atoms. In $R^{12}$, the number of carbon atoms is preferably 2.

Specific examples of the ester compound represented by general, formula (1) include ethyl lactate, isoamyl lactate, 3-hydroxybutyric acid ethyl ester, 2-hydroxybutyric acid ethyl ester, 2-hydroxyisobutyric acid methyl ester, 3-hydroxyvaleric acid ethyl ester, 2-hydroxyvaleric acid ethyl ester, 2-hydroxy-4-metyl valeric acid ethyl ester, 3-hydroxyhexane acid ethyl ester, 2-hydroxyhexane acid ethyl ester, 5-hydroxyhexane acid ethyl ester, 3-hydroxyoctanoic acid ethyl ester and 5-hydroxyoctanoic acid ethyl ester. Among them, only one or a combination of two or more can be used.

In the present invention, as to the ester compound represented by general formula (1), in $R^{11}$ of general formula (1) described above, a hydroxyl group is preferably located at β position to a carbonyl group. By the hydroxyl group being located at β position to the carbonyl group, since the carbonyl group and the hydroxyl group are more likely to be on the same side (the same plane) in terms of molecular backbone (configuration), it is considered that a large number of hydrogen bonds formed with the toner or the fiber cellulose per molecule of the ester compound represented by general formula (1) are ensured. It is considered that this is not limited to the β position, but there is a similar tendency to the σ position. In contrast, it is considered that, when the hydroxyl group is located at α position, the carbonyl group and the hydroxyl group are more likely to be arranged facing each other, and thus the number of hydrogen bonds formed with the toner or the fiber cellulose becomes smaller than that at β position. Therefore, the structure in which the hydroxyl group is located at β position is more preferable since the affinity of the fixing solution for the toner and the image support is considered to be increased.

(Ester Compound Represented by General Formula (2))

The ester compound of the fixing solution represented by general formula (2) is an ester compound of a hydroxydicarboxylic acid that is obtained by the dehydration condensation reaction of a dicarboxylic acid having a hydroxyl group and two alcohol molecules.

In general formula (2), $R^{21}$ represents a linear or branched, aliphatic hydrocarbon group having 1 to 4 carbon atoms. $R^{21}$ is preferably an ethyl group having 2 carbon atoms.

$R^{22}$ represents a linear or branched aliphatic hydrocarbon group having at least one hydroxyl group and 1 to 8 carbon atoms. $R^{22}$ is preferably an aliphatic hydrocarbon group having one hydroxyl group and 3 carbon atoms.

$R^{23}$ represents a linear or branched aliphatic hydrocarbon group having 1 to 4 carbon atoms. $R^{23}$ is preferably an ethyl group having 2 carbon atoms.

However, as the aliphatic hydrocarbon group described here, cyclic compounds are excluded.

Specific examples of the ester compound represented by general formula (2) include 2-hydroxy malonic acid diethyl ester, 2-hydroxy malonic acid diisopropyl ester, diethyl malate (2-hydroxy succinic acid diethyl ester), dibutyl malate (2-hydroxy succinic acid, dibutyl ester) 3-hydroxy glutaric acid diethyl ester (3-hydroxy pentanedioic acid diethyl ester), 2-hydroxy glutaric acid diethyl ester (2-hydroxy pentanedioic acid diethyl ester), 2-hydroxy adipic acid diethyl ester (2-hydroxy hexanedioic acid diethyl ester), 3-hydroxy adipic acid diethyl ester (3-hydroxy hexanedioic acid diethyl ester), 2-hydroxy octanedioic acid diethyl ester and 3-hydroxy octanedioic acid diethyl ester. They can be used alone or in combination of two or more of them.

In the present invention, as to the ester compound represented by general formula (2), in $R^{21}$ of general formula (2) described above, a hydroxyl group is preferably located at β position to a carbonyl group. By the hydroxyl group being located at β position to the carbonyl group, since the carbonyl group and the hydroxyl group are more likely to be on the same side (the same plane) in terms of molecular backbone (configuration), it is considered that a large number of hydrogen bonds formed with the toner or the fiber cellulose per molecule of the ester compound represented by general formula (2) are ensured. It is considered that this is not limited to β position, but there is a similar tendency to σ position. In contrast, it is considered that when the hydroxyl group is located at α position, the carbonyl group and the hydroxyl group are more likely to be arranged facing each other, and thus the number of hydrogen bonds formed with the toner or the fiber cellulose becomes smaller than that at β position. Therefore, the structure in which the hydroxyl group is located, at β position is more preferable since the affinity of the fixing solution for the toner and the image support is increased.

The specific ester compound is preferably contained at a rate of 1 to 30 mass % to the fixing solution, and more preferably 5 to 20 mass %.

The specific ester compound content falls within the range mentioned above, and thus a high affinity for the binder resin contained in the toner particles can be obtained, a high fixing strength and a high fixing rate can be obtained, and a wet feeling after the fixing is suppressed.

When the specific ester compound content is less than 1 mass %, a high affinity for the binder resin contained in the toner particles cannot be obtained, and the fixing strength and the fixing rate may be decreased. In contrast, when the specific ester compound content is more than 30 mass %, a wet feeling is present after the fixing and this may adversely affect the drying rate and the wet feeling.

(Diluent)

The fixing solution used in the image forming method of the present invention contains a diluent that dilutes and disperses the specific ester compound. As the diluent, an example thereof is water, and specifically, ion exchange water. Furthermore, a solvent that can dissolve the specific ester compound, specifically, isoparaffin, silicone oil or the like can be used.

The diluent in the fixing solution is preferably contained at a rate of 50 to 90 mass % to the fixing solution, and more preferably 80 to 90 mass %.

(Dispersing Agent)

In the fixing solution used in the image forming method of the present invention, as necessary, the dispersing agent may be contained as an agent for enhancing the solubility and dispersibility of the specific ester compound in the diluent agent.

Examples of the dispersing agent include surfactants, specifically, an anionic surfactant, a cationic surfactant, a nonionic surfactant and the like.

Examples of the anionic surfactant include, as the surfactant: higher fatty acid salts such as sodium laurate, sodium myristate and sodium oleate; alkyl aryl sulfonic acid salts such as sodium dodecyl benzene sulfonate; alkyl sulfate ester salts such as sodium lauryl sulfate; polyoxyethylene alkyl ether sulfate ester salts such as polyethoxylene ethylene sodium lauryl ether sulfate; polyoxyethylene alkyl aryl ether sulfuric acid ester salts such as polyoxyethylene nonylphenyl ether sodium sulfate; alkyl sulfosuccinate ester salts such as monooctyl sulfosuccinate sodium sulfosuccinate, sodium dioctyl sulfosuccinate, and sodium polyoxyethylene lauryl sulfosuccinate; and their derivatives. Examples of the cationic surfactant include aliphatic amine salt, aliphatic quaternary ammonium salt, benzalkonium salt, benzethonium chloride, pyridinium salt and imidazolinium salt. Examples of the nonionic surfactant include: polyoxyethylene alkyl ethers such as polyoxyethylene lauryl ether and polyoxyethylene stearyl ether; polyoxyethylene alkyl phenyl ethers such as polyoxyethylene nonylphenyl ether; sorbitan higher fatty acid, esters such as sorbitan monolaurate, sorbitan monostearate and sorbitan trioleate; polyoxyethylene sorbitan higher fatty acid esters such as polyoxyethylene sorbitan monolaurate; polyoxyethylene higher fatty acid esters such as polyoxyethylene monolaurate and polyoxyethylene monostearate; glycerol higher fatty acid esters such as oleate monoglyceride and stearic acid monoglyceride; polyoxyethylene-polyoxypropylene block copolymer; and sucrose esters such as sucrose lauric acid ester and sucrose stearic acid ester.

The dispersing agent in the fixing solution is preferably contained at a rate of zero to 10 mass %, and more preferably 1 to 5 mass %.

(Method of Manufacturing the Fixing Solution)

An example of a method of manufacturing the fixing solution is a method of sequentially putting the specific ester compound and the dispersing agent, as necessary, in a fixing solution supply tank, thereafter putting the diluent and using an ultrasonic homogenizer to agitate them at room temperature for five minutes. Therefore, it is possible to prepare the fixing solution in which the diameter of dispersed particles of the specific ester compound is 150 to 250 μm.

<Image Forming Method>

The image forming method of the present invention includes at least an electrostatic latent image formation step of forming an electrostatic latent image on an electrostatic latent image carrier, a development step of forming a toner image by developing the electrostatic latent image with a dry developer including a toner containing at least the binder resin, a transfer step of transferring the toner image to the image support and a fixing solution supply step of supplying, to the toner image transferred to the image support, the fixing solution that softens the toner, and as the fixing solution, the fixing solution described above is used.

[Electrostatic Latent Image Formation Step]

The electrostatic latent image formation step is a step of forming the electrostatic latent image on the electrostatic latent image carrier.

Although electrostatic latent image carrier is not particularly limited, examples thereof include drum-shaped electrostatic latent image carriers formed of inorganic photoreceptors such as amorphous silicon and serene, and organic photoreceptors such polysilane and phthalopolymethin.

The formation of the electrostatic latent image is performed by, for example, uniformly charging the surface of the electrostatic latent image carrier with charging means and exposing, as an image, the surface of the electrostatic latent image carrier with exposure means.

The charging means and the exposure means are not particularly limited, and means commonly used in an electrophotographic system can be used.

[Development Step]

The development step is a step of forming a toner image by developing the electrostatic latent image with a dry developer including a toner formed of toner particles containing at least a binder resin.

The formation of the toner image is performed by using, for example, an agitator that, through the use of the dry developer including the toner, frictionally agitates and charges the toner, and development means formed by a rotatable magnetic roller. Specifically, in the development means, for example, the toner and a carrier are mixed, and agitated, a friction caused at that time allows the toner to be charged, the toner is retained on the surface of the rotating magnetic roller, and a magnetic brush is formed. Since the magnetic roller is arranged near the electrostatic latent image carrier, a part of the toner constituting the magnetic brush formed on the surface of the magnetic roller is moved to the electrostatic latent image carrier by an electrical suction force. Consequently, the electrostatic latent image is developed with the toner and the toner image is formed on the surface of the electrostatic latent image carrier.

[Toner]

The toner used in the image forming method of the present invention includes toner particles containing at least a binder resin. The toner particles may contain, as necessary, internal additives such as a coloring agent, aparting agent, a magnetic powder and a charge control agent, and external additives such as a fluidizer may be externally added to the toner particles.

The particles of the toner used in the image forming method of the present invention have a volume-based median diameter of preferably 3.5 to 7.0 μm, and more preferably 5.0 to 6.5 μm.

The volume-based median diameter in the toner fails within the range mentioned above, and thus the specific surface area of the toner is sufficiently ensured. Therefore, since, in the fixing solution supply step described later, the contact area with the fixing solution is sufficiently ensured, it is possible to reliably fix the toner image on the image support, and thus the sufficient fixing strength can be obtained in a formed image.

When the volume-based median diameter of the toner is less than 3.5 μm, the formed image may be rough. In contrast, when the volume-based median diameter of the toner is more than 7.0 μm, the specific surface area of the toner is low, the contact area with the fixing solution is insufficiently ensured in the fixing solution supply step described later, and it is likely that the toner image cannot be reliably fixed on the image support.

In the present invention, the volume-based median diameter of the toner is measured and calculated through the use of a measurement device in which a computer system equipped with a data processing software program "Software V3.51" is connected to "Coulter Multisizer 3" (manufactured by Beckman Coulter, Inc).

Specifically, 0.02 g of a specimen (toner) is added and soaked in 20 mL of a surfactant solution (for example, a surfactant solution obtained by diluting, by a factor of 10, with pure water, a neutral detergent containing a surfactant component in order to disperse the toner particles), thereafter ultrasonic dispersion is performed for one minute to prepare the dispersion solution and the dispersion solution is poured with a pipette into a beaker containing "ISOTONII" (manufactured by Beckman Coulter, Inc.) within a sample stand until a concentration displayed on the measurement device becomes 8%. Here, by setting this concentration range described above, it is possible to obtain a reproducible measurement value. Then, in the measurement device, a frequency value is calculated by setting the count number of particles measured to 25000, setting the aperture diameter to 50 μm, dividing the measurement range of 1 to 30 μm into 256 parts, and the size of particles having 50% diameter in descending order in volume-based cumulative fractions is set to the volume-based median diameter.

The average degree of circularity of the toner used in the image forming method of the present invention is preferably 0.930 to 1.000 from the viewpoint of improving transfer efficiency, and is more preferably 0.950 to 0.905.

In the present invention, the average degree of circularity of the toner is measured through the use of "FPIA-2100" (manufactured by Sysmex Corporation).

Specifically, the specimen (toner) is soaked in a surfactant-containing aqueous solution, is subjected to ultrasonic dispersion treatment for one minute to disperse the specimen, thereafter shooting is performed with the "FPIA-2100" (manufactured by Sysmex Corporation) in a measurement condition HPF (high magnification shooting) mode in an appropriate concentration of a HPF detection number of 3,000 to 10,000, the degree of circularity of each toner particle is calculated in accordance with the following formula (T), the degrees of circularity of the individual toner particles are added and it is divided by the number of all toner particles, with the result that the average degree of circularity is calculated.

circularity=(circumferential length of a circle having the same projection area as a particle image)/(circumferential length of an image of a particle) Formula (T):

The glass transition temperature of the toner used in the image forming method of the present invention is preferably 30 to 70° C. from the viewpoint of heat-resistant storage arid flocking resistance, and is more preferably 35 to 50° C.

In the present invention, the glass transition temperature of the toner is measured through the use of a differential scanning calorimeter "DSC8500" (manufactured by PerkinElmer Co., Ltd.).

Specifically, 4.5 mg of the specimen (toner) is accurately weighed with a balance to two places of decimals, is sealed in an aluminum pan, and is set in a sample holder DSC-7, As the reference, an empty aluminum pan is used, Heat-Cool-Heat temperature control is performed under the conditions of a measurement temperature of 0 to 200° C., a temperature rise rate of 10° C./minute and a temperature drop rate of 10° C./minute, and analysis is performed on the basis of data in the second heat. The value of an inter section between the extension line of a baseline before the rise of the first endothermic peak and a tangent indicating the maximum gradient between the rise part of the first endothermic peak and the peak vertex is defined as the glass transition temperature.

The softening temperature of the toner used in the image forming method of the present Invention is preferably 90 to 120° C. from the viewpoint of the fixing strength, and is more preferably 100 to 115° C.

In the present invention, the softening temperature of the toner is measured as follows.

Specifically, under the circumstances of a temperature of 20±1° C. and humidity of 50±5% RH, 1.1 g of the specimen (toner) is put in a petri dish and is flattened, and is left for 12 or more hours, is thereafter pressurized by a force of 3820 kg/cm$^2$ for 30 seconds with a molding machine "SSP-10A" (manufactured by Shimadzu Corporation) into a cylindrical molded sample having a diameter of 1 cm; then, this molded sample is extruded at the time of the completion of preheating, through a cylindrical die hole (1 mm diameter×1 mm) with a piston having a diameter of 1 cm, under the circumstances of a temperature of 24±5° C. and humidity of 50±20% RH, and under the conditions of a load of 1.96 N (20 kgf), a start temperature of 60° C., a preheat time of 300 seconds and a temperature rise rate of 6° C./minute through the use of a flow tester "CFT-500D" (manufactured by Shimadzu Corporation), and an offset temperature $T_{offset}$ is measured at a setting of an offset value of 5 mm, as the softening temperature, in a melting temperature measurement method that is a temperature rise method.

(Binder Resin)

Examples of the binder resin contained in the toner particles according to the present invention include various known resins such as styrene resin, (meth)acrylic resin, styrene-(meth) acrylic resin, polyester resin, polyether polyol resin and polyvinyl acetate resin. Among them, from the viewpoint of affinity with the softening agent, polyester resin is preferable.

When, as the binder resin, styrene resin, (meth)acrylic resin or styrene-(meth) acrylic resin is used, examples of a polymerizable monomer forming the binder resin include vinyl monomers such as: styrenes and styrene derivatives such as styrene, o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene and p-n-dodecyl styrene; methacrylic acid, ester derivatives such as methyl methacrylate, ethyl methacrylate, n-butyl methacrylate, isopropyl methacrylate, isobutyl methacrylate, t-butyl methacrylate, n-octyl methacrylate, methacrylic acid-2-ethylhexyl, stearyl methacrylate, lauryl methacrylate, phenyl methacrylate, diethylaminoethyl methacrylate and dimethylaminoethyl methacrylate; acrylic acid ester derivatives such as methyl acrylate, ethyl acrylate, isopropyl acrylate, n-butyl acrylate, t-butyl acrylate, isobutyl acrylate, n-octyl acrylate, acrlic acid-2-ethylhexyl and phenyl acrylate; olefins such as ethylene, propylene and isobutylene; and acrylic acids and methacrylic acid derivatives such as acrylonitrile, methacrylonitrile and acrylamide. These vinyl monomers can be used alone or in combination of two or more of them.

Furthermore, as the polymerizable monomer that forms the binder resin, a combination of the polymerizable monomer described above and a polymerizable monomer having an ionic dissociable group is preferably used. The polymerizable monomer having an ionic dissociable group has, as a constituent group, a substituent group such as a carboxyl group, a sulfonic acid group or a phosphoric acid group. Specific examples include acrylic acid, methacrylic acid, maleic acid, itaconic acid, cinnamic acid, fumaric acid, monoalkyl ester maleate, monoalkyl ester itaconic acid, styrene sulfonic acid, allyl sulfonate succinic acid and 2-acrylamido-2-methylpropane sulfonic acid.

Furthermore, as the polymerizable monomer, a polyfunctional vinyl is used such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate or neopentyl glycol diacrylate; thus, it is also possible to obtain a cross-linked binder resin.

When, as the binder resin, polyester resin is used, polyester resin can be obtained by a known polyhydric alcohol and a known polycarboxylic acid.

Examples of the polyhydric alcohol include: aliphatic diols such as ethylene glycol, 1,3-propanediol, 1,4-butanediol, 1,5-pentanediol, 1,6-hexanediol, 1,7-heptane diol, 1,8-octanediol, 1,9-nonanediol, 1,10-decane diol, 1,11-undecane diol, 1,12-dodecanediol, 1,13-tri-decanediol, 1,14-tetra-decane diol, 1,18-octadecane diol and 1,20-eicosanic diol; bisphenols such as bisphenol A and bisphenol F; and alkylene oxide adducts of these bisphenols such as ethylene oxide adduct and propylene oxide adduct. Examples of trivalent or more polyhydric alcohols include glycerol, pentaerythritol, trimethylolpropane and sorbitol. Examples of polyhydric alcohols having an unsaturated group include: polyhydric alcohols having an unsaturated double bond such as 2-butene-1, 4-diol, 3-butene-1,6-diol, 4-butene-1,8-diol and 9-octadecene-7,12-diol; and polyhydric alcohols having an unsaturated triple bond such as 2-butyne-1,4-diol and 3-butyne-1, 4-diol. Among these polyhydric alcohols, only one or a combination of two or more can be used.

Examples of the polycarboxylic acid include: aliphatic carboxylic acids such as oxalic acid, malonic acid, succinic acid, glutaric acid, adipic acid, pimelic acid, suberic acid, azerin acid, sebacic acid, 1,9-nonanedicarboxylic acid, 1,10-decanedicarboxylic acid, 1,11-undecanedicarboxylic acid, 1,12-dodecane dicarboxylic acid, 1,13-tridecanedicarboxylic acid, 1,14-tetradecanedicarboxylic acid, 1,16-hexadecanedicarboxylic acid and 1,18-oxtadecanedicarboxylic acid; lower alkyl esters and anhydrides of these aliphatic carboxylic acids; aromatic carboxylic acids such as phthalic acid, isophthalic acid, terephthalic acid, orthophthalic acid, t-butyl isophthalic acid, 2,6-naphthalene dicarboxylic acid and 4,4'-biphenyl dicarboxylic acid; and trivalent or more polycarboxylic acids such as trimellitic acid and pyromellitic acid. Examples of the polycarboxylic acid having an unsaturated group include: unsaturated aliphatic carboxylic acids such as maleic acid, fumaric acid, itaconic acid, citraconic acid, glutaconic acid, isodecenyl succinic acid, n-dodecenyl succinic acid and n-octenyl succinic acid; anhydrides or acid chlorides of these acids; and unsaturated aromatic carboxylic acids such as caffeic acid. Among these polycarboxylic acids, only one or a combination of two or more can be used.

The polyester resin can be manufactured by, for example, the condensation polymerization of the polyhydric alcohol and the polycarboxylic acid, described above in an atmosphere of an inert gas at a temperature of 120 to 250° C. At the time of the condensation polymerization, a known esterification catalyst may be used as necessary.

When styrene-(meth) acrylic resin is used, a dissociation acid monomer content in the binder resin is preferably 0 to 20% and is more preferably 5 to 15%, and when the polyester resin is used, it is preferably 10 to 50% and is more preferably 20 to 50%.

The glass transition temperature of the binder resin is preferably 30 to 70° C. and is more preferably 35 to 45° C.

When the glass transition temperature of the binder resin is less than 30° C., satisfactory heat-resistant storage may not be obtained.

In the present invention, the glass transition temperature of the binder resin is measured in the same way as the way in which the glass transition temperature of the toner described above is measured, except that the specimen is replaced with the binder resin.

The weight-average molecular weight of the binder resin is preferably 3,000 to 100,000 and is more preferably 5,000 to 50,000.

When the weight-average molecular weight of the binder resin is less than 3,000, the strength of the toner particles is decreased, and the toner scattering is caused. In contrast, when the weight-average molecular weight of the binder resin is more than 100,000, a high fixing strength of a formed image may not be obtained.

In the present invention, the weight-average molecular weight of the binder resin is measured with a GPC.

Specifically, a device "HLC-3220" (manufactured by Tosoh Corporation) and a column "TSK guard column+TSK gel Super HZM-M3 series" (manufactured by Tosoh Corporation) are used, tetrahydrofuran (THF) is caused, to flow as a carrier solvent at a flow rate of 0.2 mL/minute while the column temperature is maintained at 40° C., the specimen (binder resin) is dissolved in THF under dissolving conditions in which the processing is performed with an ultrasonic disperser at room temperature for 5 minutes such that its concentration is 1 mg/mL, then processing is performed with a membrane filter having a pore size of 0.2 μm to obtain, a specimen solution, 10 μL of the specimen solution is poured into the device together with the carrier solvent, detection is performed, with a refractive index detector (RI detector) and the molecular weight distribution of the specimen is calculated with a standard curve measured using monodispersed polystyrene standard particles. Ten items of polystyrene for the standard curve measurement are used.

(Coloring Agent)

When the toner particles according to the present invention contain a coloring agent, the coloring agent is not particularly limited, and a known coloring agent can be used.

Examples of a black coloring agent include carbon blacks such as a furnace black, a channel black, an acetylene black, a thermal black and a lamp black.

Examples of a magenta or red coloring agent include C. I. pigment red 2, C. I. pigment red 3, C. I. pigment red 5, C. I. pigment red 6, C. I. pigment red 7, C. I. pigment red 15, C. I. pigment red 16, C. I. pigment red 48; 1, C. I. pigment red 53; 1, C. I. pigment red 57; 1, C. I. pigment red 122, C. I. pigment red 123, C. I. pigment red 139, C. I. pigment red 144, C. I. pigment red 149, C. I. pigment red 166, C. I. pigment red 177, C. I. pigment red 178 and C. I. pigment red 222.

Examples of an orange or yellow coloring agent include C. I. pigment orange 31, C. I. pigment orange 43, C. I. pigment yellow 12, C. I. pigment yellow 13, C. I. pigment yellow 14, C. I. pigment yellow 15, C. I. pigment yellow 74, C. I. pigment yellow 93, C. I. pigment yellow 94, C. I. pigment yellow 138, C. I. pigment yellow 100 and C. I. pigment yellow 104.

Examples of a green or cyan coloring agent include C. I, pigment blue 15, C. I. pigment blue 15; 2, C. I. pigment blue 15; 3, C. I. pigment blue 15; 4, C. I. pigment blue 16, C. I. pigment blue 60, C. I. pigment blue 62, C. I. pigment blue 66 and C. I. pigment green 7.

These coloring agents can be used alone or in combination of two or more of them.

The content rate of a coloring agent is preferably 1 to 10 parts by mass to 100 parts by mass of the binder resin, and is more preferably 2 to 9 parts by mass.

(Parting Agent)

When the toner particles according to the present invention contain a parting agent, an example of the parting agent is a wax. Specifically, examples thereof include:

(1) Polyolefin-based waxes Polyethylene wax, polypropylene wax and the like
(2) Long-chain hydrocarbon waxes Paraffin wax, sasol wax and the like
(3) Dialkyl ketone-based waxes Bistearyl ketone wax and the like
(4) Ester-based waxes Carnauba wax, montan wax, trimethylolpropane tribehenate, pentaerythritol tetra-myristate, pentaerythritol tetrastearate, pentaerythritol tetra behenate, pentaerythritol diacetate dibehenate, glycerin tribehenate, 1,18-octadecanediol distearate, behenyl behenate, stearyl stearate, trimellitic acid tristearyl, distearyl maleate and the like
(5) Amide-based waxes Ethylenediamine dibehenyl amide, trimellitic acid tristearyl amide and the like.

The content rate of a parting agent is preferably 0 to 10 parts by mass to 100 parts by mass of the binder resin, and is more preferably 5 to 10 parts by mass.

(Magnetic Powder)

When the toner particles according to the present invention contain a magnetic powder, examples of the magnetic powder include magnetite, γ-hematite, various ferrites and the like.

The content rate of a magnetic powder agent is preferably 10 to 500 parts by mass to 100 parts by mass of the binder resin, and is more preferably 20 to 200 parts by mass.

(Charge Control Agent)

When the toner particles according to the present invention contain a charge control agent, the charge control agent is not particularly limited as long as the charge control agent can provide positive charge or negative charge through frictional charging. Various known positive charge control agents and negative charge agents can be used.

The content rate of a charge control agent is preferably 0.1 to 10 parts by mass to 100 parts by mass of the binder resin, and is more preferably 0.5 to 5 parts by mass.

(External Additives)

Although the toner particles according to the present invention can be used as toner as is, in order to improve fluidity, electrostatic property, cleaning ability and the like, the toner particles can be used with so-called external additives such as a fluidizer and a cleaning aid added thereto.

Examples of the fluidizer includes inorganic particulates formed of silica, alumina, titanium oxide, sine oxide, iron oxide, copper oxide, lead oxide, antimony oxide, yttrium, oxide, magnesium oxide, barium titanate, ferrite, red iron oxide, magnesium fluoride, silicon carbide, boron carbide, silicon nitride, nitride zirconium, magnetite, magnesium stearate and the like.

These inorganic particulates are preferably subjected to surface processing in order to enhance dispersibility on the surface of the toner particles and environmental stability by using a silane coupling agent, a titanate coupling agent, a higher fatty acid, silicone oil and the like.

Examples of the cleaning aid include polystyrene particles and poly (methyl methacrylate) fine particles.

The external additives can be used in combination of various external additives.

The average primary particle size of the external additive is preferably 30 nm or less.

The content rate of an external additive is preferably 0.05 to 5 parts by mass to 100 parts by mass of the toner particles, and is more preferably 0.1 to 3 parts by mass.

Examples of methods of manufacturing the toners described above include drying methods such as a powder grinding method, and wet methods such as an emulsification association method, a dissolution desolvation method and a dissolution suspension method.

[Dry Developer]

The developer used in the image forming method of the present invention is a dry type, and may be a one-component developer including a magnetic or non-magnetic toner or a two-component developer formed by mixing the toner and the carrier.

When the two-component developer is used, there can be used, as the carrier, magnetic particles including a conventionally known material such as iron, ferrite or magnetite and such as an alloy of a metal such as iron, ferrite or magnetite and a metal such as aluminum or lea, and in particular, ferrite particles are preferable. Moreover, there may be used, as the carrier, a resin coating carrier in which the surface of the magnetic particles is coated, with a coating agent such as a resin, a dispersion-type carrier obtained by dispersing magnetic particulate powder in a binder resin, or the like.

The carrier particle has a volume-based median diameter of preferably 15 to 100 μm, and more preferably 20 to 80 μm.

The volume-based median diameter of the carrier can be typically measured with a laser diffraction type particle size distribution measurement device "HELOS" (manufactured by SYMPATEC Co. Ltd.) provided with a wet disperser.

[Transfer Step]

The transfer step is a step in which the toner image is transferred to the image support.

The transfer of the toner image to the image support is performed by carrying out peeling electrification of the toner image on the image support.

As transfer means, for example, a corona transfer unit using corona discharge, a transfer belt and a transfer roller can be used.

Furthermore, the transfer step can be performed by, for example, a mode in which, through the use of an intermediate transfer body, the toner image is primarily transferred onto the intermediate transfer body and then secondarily transferred onto the image support, a mode in which the toner image formed on the electrostatic latent image is directly transferred to the image support, or the like.

The image support is not particularly limited, and examples thereof include various types such as plain paper, high-quality paper and art paper ranging from thin paper to thick paper, coated printing paper such as coat pater, commercially available Japanese paper and postcard paper, plastic film for OHP, and cloth.

[Fixing Solution Supply Step]

The fixing solution supply step is a step in which the fixing solution for softening toner is supplied to the toner image transferred to the image support, and the fixing solution described above is used as the fixing solution.

The supply amount of fixing solution is preferably 0.4 g or less per, for example, A4-size image support, and is more preferably 0.1 g or less.

Here, the "A4-size" is a size of A4 in A series specified in an international standard "ISO 216", and specifically, the size is 210 mm×297 mm.

Examples of methods of supplying the fixing solution include a method of using fixing solution supply means to, for example, inject, spray or coat the fixing solution in the form of a liquid, or a foam, and the like.

Examples of the fixing solution supply means include a sprayer using an inkjet nozzle and an ultrasonic vibrator, a sprayer using a compressed air, a sprayer that forms liquid droplets electrostatically, and a roller.

The method of supplying the fixing solution adopted in the image forming method of the present invention will be specifically described below.

FIG. 1 is an illustrative cross-sectional view showing an example of the configuration of the fixing solution supply means used in the image forming method of the present invention.

This fixing solution supply means 50A includes a line-type inkjet nozzle, and is arranged on the downstream side of a toner image carrier 31.

In the fixing solution supply means 50A described above, the fixing solution F formed into liquid droplets is supplied to the toner image T in accordance with the region of the toner image T transferred onto the image support P.

In the line-type inkjet of the fixing solution supply means 50A described above, its resolution is preferably 300 dpi or more. Furthermore, the size of the liquid droplet of the inkjet is preferably 0.5 to 50 pl.

Note that, when the inkjet nozzle is used as the fixing solution supply means 50A, the fixing solution needs to have solvent resistance.

In addition, when the fixing solution is not liquid at a room temperature or more, or when the fixing solution has a high viscosity, it can be configured such that a heater is provided in the fixing solution supply means 50A.

Figure 2:
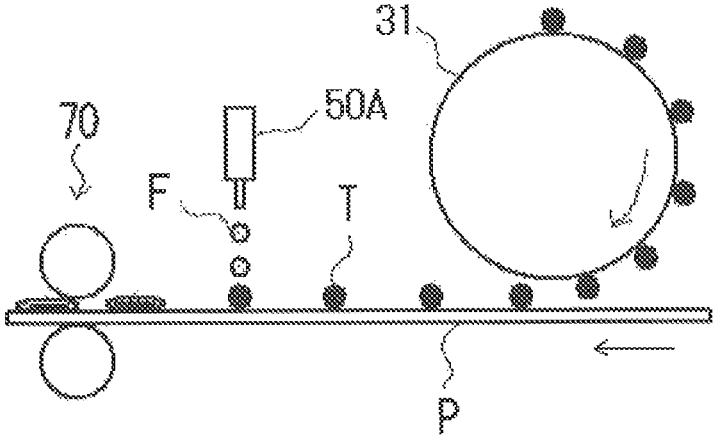
FIG. 2 is an illustrative cross-sectional view showing an example of the configuration of the fixing solution supply means and pressure application means used in the image forming method of the present invention.

Moreover, after the fixing solution supply step, a pressure application step of applying a pressure to the toner image T to which the fixing solution F is supplied is preferably performed. Specifically, as shown in FIG. 2, after the fixing solution supply step, through the use of pressure application means 70 including a pair of pressuring rollers, a pressure can be applied to the toner image T to which the fixing solution F is supplied.

As the pressure application means, for example, rollers whose surfaces are separable or the like can be used. Although the applied pressure is not particularly limited, it is preferably, for example, 50 kPa to 1 MPa.

Through the pressure application step described above, it is possible to obtain a high fixing strength in the formed image.

Figure 3:
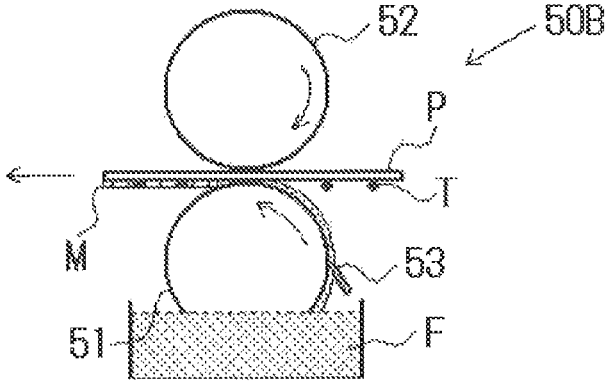
FIG. 3 is an illustrative cross-sectional view showing another example of the configuration of the fixing solution supply means used in the image forming method of the present invention.

FIG. 3 is an illustrative cross-sectional view showing another example of the configuration of the fixing solution supply means used in the image forming method of the present invention.

This fixing solution supply means 50B is constituted by a fixing solution coating roller 51 and a pressurizing roller 32 that is provided facing the fixing solution coating roller 51. A portion of the fixing solution coating roller 51 described above is immersed in, for example, the liquid fixing solution F. In addition, a metalling blade 53 controlling the amount of fixing solution F to be supplied onto the toner image T is provided with its end portion in a state of being separated from the surface of the fixing solution coating roller 51.

In the fixing solution supply means 50B described above, by means of rotary driving of the fixing solution coating roller 51 and the pressurizing roller 52, the amount of liquid fixing solution F supplied on the fixing solution coating roller 51 is regulated by the metalling blade 53, and thus the fixing solution F is supplied, as a liquid film M, to the entire surface of the image support P to which the toner image T is transferred and a pressure is applied by the pressurizing roller 52.

The thickness of the liquid film M is not particularly limited; for example, it is preferably 1 to 100 μm.

Furthermore, the pressure applied by the pressurizing roller 52 is preferably, for example, 150 to 250 MPa.

Figure 4:
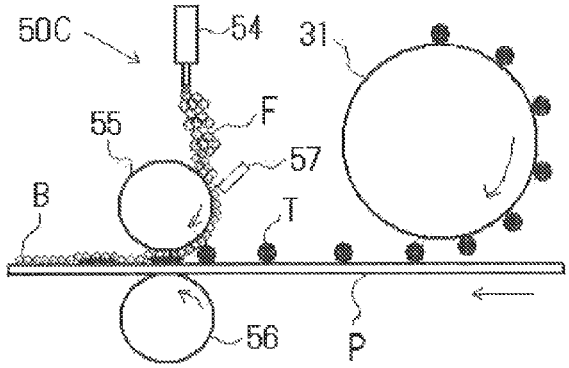
FIG. 4 is an illustrative cross-sectional view showing yet another example of the configuration of the fixing solution supply means used in the image forming method of the present invention.

FIG. 4 is an illustrative cross-sectional view showing yet another example of the configuration of the fixing solution supply means used in the image forming method of the present invention.

This fixing solution supply means 50C includes a foam generation device 54 that sprayers the foamed fixing solution, a fixing solution coating roller 55 and a pressurizing roller 56 provided facing the fixing solution coating roller 55. In addition, a regulation blade 57 controlling the amount of fixing solution F to be supplied onto the toner image T is provided with its end portion in a state of being separated from the surface of the fixing solution coating roller 55.

In the fixing solution supply means 50C described above, by means of rotary driving of the fixing solution coating roller 55 and the pressurizing roller 56, the amount of liquid fixing solution F supplied on the fixing solution coating roller 55 is regulated by the regulation blade 57, and thus the fixing solution F is supplied, as a foamed film B, to the entire surface of the image support P to which the toner image T is transferred and a pressure is applied by the pressurizing roller 56.

Although the thickness of the foamed film 3 is not particularly limited, it is preferably, for example, 50 to 80 μm.

In addition, the pressure applied by the pressurizing roller 56 is preferably, for example, 150 to 250 MPa.

Figure 5:
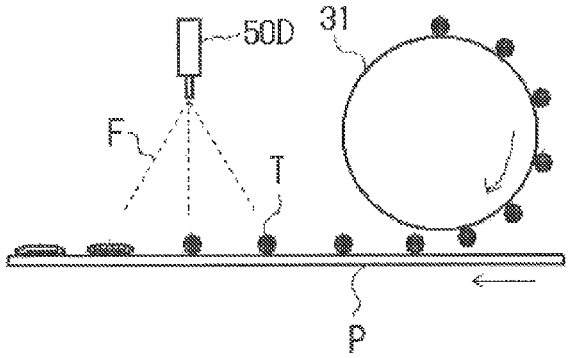
FIG. 5 is an illustrative cross-sectional view showing still another example of the configuration of the fixing solution supply means used in the image forming method of the present invention.

FIG. 5 is an illustrative cross-sectional view showing still another example of the configuration of the fixing solution supply means used in the image forming method of the present invention.

This fixing solution supply means 50D includes a sprayer using a compressed air, and is arranged on the downstream side of the toner image carrier 31.

In the fixing solution supply means 50D described above, the liquid fixing solution F is sprayed and is supplied to the toner image T transferred onto the image support P.

The image forming method of the present invention can be performed with, for example, an image forming device described above.

Figure 6:
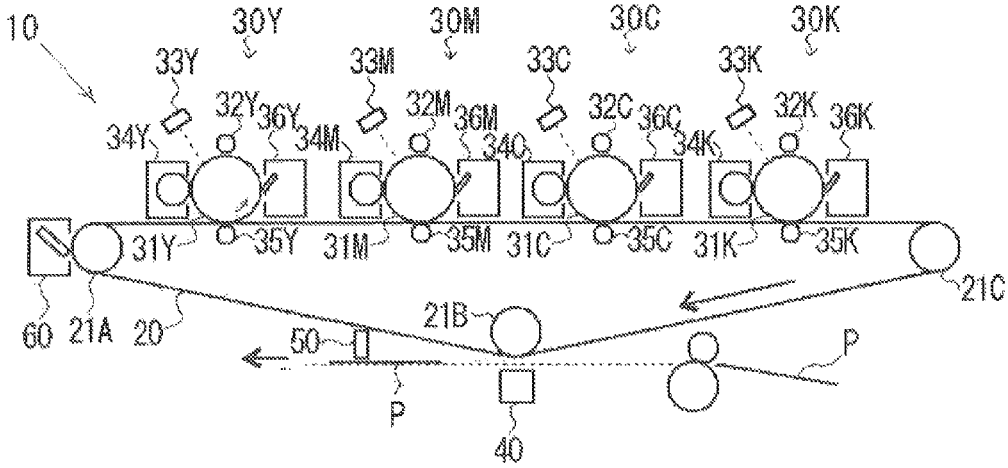
FIG. 6 is a schematic diagram showing an example of the configuration of an image forming device used in the image forming method of the present invention.

FIG. 6 is a schematic diagram showing an example of the configuration of the image forming device used in the image forming method of the present invention.

This image forming device 10 is a tandem full-color image forming device, and there are provided, a plurality of image formation units 30Y, 30M, 30C and 30K provided along a belt-shaped, intermediate transfer body 20, secondary transfer means 40 that transfers the toner image formed on the intermediate transfer body 20 by each image formation unit to the image support P, and fixing solution supply means 50 that supplies the fixing solution to the toner image transferred onto the image support P.

The image formation unit 30Y forms a yellow toner image, includes a drum-shaped photoreceptor 31Y that is an electrostatic latent image carrier, and it is configured such that charging means 32Y, exposure means 33Y, developing means 34Y, primary transfer means 35Y and cleaning means 36Y are arranged around the photoreceptor 31Y described above.

The image formation units 30M, 30C and 30K have the same configuration as the image formation unit 30Y except that they respectively forms magenta, cyan and black toner images instead of forming the yellow toner image.

The intermediate transfer body 20 is placed over a plurality of support rollers 21A, 21B and 21C, and is supported such that the intermediate transfer body 20 can move cyclically.

The secondary transfer means 40 includes a transfer unit that carries out peeling electrification of the toner image on the image support P and transfers the image to the image support P.

The fixing solution supply means 50 supplies the fixing solution in the form of liquid droplets to the toner image, and includes, for example, a line-type jet nozzle.

In the image forming device 10 described above, the following image formation processing is performed.

When, in the image formation unit 30Y, the photoreceptor 31Y is driven and rotated, the charging means 32Y provides a uniform potential on the surface of the photoreceptor 31Y by using a corona discharge with the same polarity as the toner. An electrostatic latent image is formed on the surface of the uniformly charged photoreceptor 31Y on the basis of image data, by performing scanning parallel to the rotational direction of the photoreceptor 31Y and performing exposure through the exposure means 33Y. Then, through the developing means 34Y, the toner charged with the same polarity as the surface potential of the photoreceptor 31Y adheres to the electrostatic latent image of the photoreceptor 31Y, to thereby perform reversal development, and thus the toner image is formed and is transferred onto the cyclically moving intermediate transfer body 20 through the primary transfer means 35Y. The processing described above is also performed in the image formation units 30M, 30C and 30K, and thus the toner images of the respective colors formed by the image formation units 30Y, 30M, 30C and 30K are superimposed on the intermediate transfer body 20 to form a color toner image. This color toner image is secondarily transferred, by the secondary transfer means 40 onto the image support P transported at a predetermined timing. Then, the fixing solution supply means 50 supplies, on the basis of the image data, the fixing solution to the toner image secondarily transferred to the image support P. The toner image to which the fixing solution is supplied is fixed to form an image.

In contrast, after the color toner image is transferred to the image support P by the secondary transfer means 40, the cleaning means 60 removes the untransferred toner remaining on the intermediate transfer body 20 which curvature-separates the image support P. The cleaning means 36Y, 36M, 36C and 36K respectively remove the untransferred, toner remaining on the photoreceptors 31Y, 31M, 31C and 31K.

According to the image forming method of the present invention, in a wet fixing system, through the use of the fixing solution containing the specific ester compound as the softening agent, it is possible to increase the fixing rate and the drying rate while reducing the supply amount of fixing solution and to reduce a wet feeling on the formed image and obtain a high fixing strength.

EXAMPLES

Production Example 1 of the Toner (1) Preparation of a Binder Resin Particle Dispersion Solution In a reaction container having an agitation device, a temperature sensor, a cooling tube and a nitrogen introduction device, 4 parts by mass of $C_{10}H_{21}(OCH_2CH_2)_2SO_3Na$ anionic surfactant was put together with 3040 parts by mass of ion exchange water, and thus a surfactant aqueous solution was prepared. To the surfactant aqueous solution described above, a polymerization initiator solution obtained by dissolving 10 parts by mass of potassium persulfate in 400 parts by mass of ion exchange water was added, the temperature was increased to 75° C. and thereafter a monomer solution formed of 532 parts by mass of styrene, 200 parts by mass of n-butyl acrylate, 68 parts by mass of methacrylic acid and 16.4 parts by mass of n-octylmercaptan was dropped into the reaction container for 1 hour. After the dropping, the resultant substance was polymerized by being heated and agitated at 75° C. for 2 hours, and thus there was prepared a binder resin particle dispersion solution [1] in which binder resin particles were dispersed. The glass transition temperature of the binder resin particles produced was 40° C., and the weight-average molecular weight thereof was 35,000. The content of a dissociation acid monomer in the binder resin particles was 5%.

(2) Preparation of a Coloring Agent Particle dispersion solution 7 parts by mass of "DOW FAX 2A-1" (manufactured by the Dow Chemical Company) was put in 160 parts by mass of ion exchange water, was dissolved and agitated and a surfactant aqueous solution was prepared. To the surfactant aqueous solution described above, 20 parts by mass of carbon black was gradually added, dispersion processing was performed through the use of "SC mill" (manufactured by Mitsubishi Materials Corporation) and a coloring agent particle dispersion solution [1] was prepared. The coloring agent particles were measured through the use of "MICROTRAC UPA-150" (manufactured by Honeywell), and the volume-based median diameter of the particles was 200 nm.

(3) Preparation of the Toner Particles

In a reaction container including an agitation device, a temperature sensor, a cooling tube and a nitrogen introduction device, 420.7 parts by mass (in terms of solid content) of the binder resin particle dispersion solution [1] , 900 parts by mass of ion exchange water and 200 parts by mass of the coloring agent particle dispersion solution [1] were put and agitated.

Then, an aqueous solution obtained by dissolving 2 parts by mass of magnesium chloride hexahydrate in 1000 parts by mass of ion exchange water was added under agitation at 30° C. for 10 minutes. The resultant substance was left for 3 minutes and the temperature thereof started to be increased, this system was increased to 65° C. for 60 minutes, and thus association between the binder resin particles and the coloring agent particles was performed. In this state, through the use of "Coulter Multisizer 3" (manufactured by Coulter, Inc.) the size of the associated particles was measured, arid when the volume-based median diameter reaches 21 μm, an aqueous solution obtained by dissolving 40.2 parts by mass of sodium chloride in 1000 parts by mass of ion exchange water was added to stop the association.

Thereafter, as aging processing, the liquid temperature was changed to 70° C., heating and agitation were performed for 1 hour and thus fusion was continued. At this time, the average degree of circularity of the particles was 0.940. Furthermore, it was cooled to 30° C. at a rate of 8° C./minute, was filtered, was repeatedly washed with ion exchange water of 45° C. and was dried with hot air of 40° C., with the result that the toner particles was obtained. The volume-based median diameter of the toner particles [1] was 6.2 μm.

To 100 parts by mass of the toner particles [1] , "Henschel mix" (manufactured by Mitsui Miike Mining Co. Ltd.) was used to add, 0.6 parts by mass of silica (average primary diameter of 12 nm) subjected to Hexamethyldisilasane processing and 0.8 parts by mass of titanium dioxide (average primary diameter of 24 nm) subjected to n-octyl silane processing, with the result that the toner [1] was produced.

Production Example 2 of the Toner

A toner [2] was produced in the same manner as in the Production example 1 of the toner except that the amount of methacrylic acid added in the preparation of the binder resin particle dispersion solution was changed to 120 parts by mass. The glass transition temperature of the binder resin particles produced was 42° C., and the weight-average molecular weight thereof was 30,000. In addition, the content of a dissociation acid monomer in the binder resin particles produced was 15%.

Production Example 3 of the Toner

In a flask having an agitation device, a nitrogen introduction tube, a temperature control device and a distillation column, the following polycarboxylic acid and polyhydric alcohol were poured, the temperature of this reaction solution was increased to 190° C. for 1 hour, and after it was confirmed that the reaction system was uniformly agitated, a catalyst $Ti(OBu)_4$ (0.003 mass % to the total amount of carboxylic acid component of the polyester resin) was put in.

(Polycarboxylic Acid)

terephthalic acid: 30 parts by mass isophthalic acid: 3 parts by mass adipic acid: 3 parts by mass (Polyhydric alcohol)

2-mol adduct of 2,2-bis(4-hydroxyphenyl) propanepropylene oxide: 75 parts by mass 2-mol adduct of 2,2-bis(4-hydroxyphenyl) propaneethylene oxide adduct: 25 parts by mass Furthermore, while the generated water was being distilled away, the temperature was increased to 240° C. for 6 hours, the dehydration condensation reaction was continued and polymerized at 240° C. for further 6 hours and thus the polyester resin [1] was obtained. The glass transition temperature of the polyester resin [1] was 40° C., and the weight-average molecular weight thereof was 40,000. Moreover, the content of a dissociation acid monomer in the polyester resin [1] was 26%.

Then, 400 parts by mass of the polyester resin [1] was put in 1700 parts by mass of ethyl acetate, and was increased to 70° C., dissolved and mixed, with the result that a resin solution [1] was obtained.

Separately, 2000 parts by mass of ion exchange water and 4.8 parts by mass of dodecyl sodium sulfate were agitated and dispersed, and thus a water phase serving as a continuous phase was prepared. In the water phase, the resin solution [1] was put while being agitated with "TK homomixer Mark II 2.5 type" (manufactured by PRIMIX Corporation), and oil droplets were prepared by adjusting the number of agitating revolutions. Thereafter, vacuum distillation was performed at 50° C. to remove ethyl acetate, and thus a binder resin particle dispersion solution [3] having a solid content of 20 parts by mass was obtained. The volume-based median diameter of the binder resin particles was 180 nm.

272 parts by mass (in terms of solid content) of the binder resin particle dispersion solution [3], 2200 parts by mass of ion exchange water and 98 parts by mass of the coloring agent particle dispersion solution [1] were put in a separable flask provided with a temperature indicator, a cooling tube, a nitrogen introduction device and an agitation device. Furthermore, with the temperature of the system maintained at 30° C., a sodium hydroxide aqueous solution (25 mass %) was added such that the pH was adjusted to be 10.

Then, an aqueous solution obtained by dissolving 54.3 parts by mass of magnesium chloride hexahydrate in 54.3 parts by mass of ion exchange water was added, and thereafter the temperature within the system is increased to 60° C., and thus the aggregation reaction between the binder resin particles and the coloring agent particles was started.

After the start of the aggregation reaction, sampling was periodically performed, and when the volume-based median diameter (D50) of the particles reached 6.0 μm through the use of the particle size distribution measurement device "Coulter Multisizer 3" (manufactured by Beckman Coulter, Inc.), 20.1 parts by mass of ethylenediamine tetraacetic acid was added. The degree of circularity of the particles at this point was 0.92.

When the temperature was increased, and the degree of circularity of the particles reached 0.96, the suspension solution was cooled to 10° C. under a condition of 6° C./minute, and the toner particle dispersion solution was obtained.

Then, solid-liquid separation of the generated toner particle dispersion solution was performed with a basket type centrifugal separator "MARK III type" (model number 60×40) (manufactured by Matsumoto Kikai Manufacturing. Co., Ltd.), and the wet cake of the toner was formed. Thereafter, the cleaning and the solid-liquid separation of the toner were repeated until the electrical conductivity of the filtrate reached 15 μS/cm or less.

Then, the wet cake was moved to a jet-type dryer "flash jet dryer" (manufactured by Seishin Enterprise Co., Ltd.), and dry processing was performed until the water content reached 0.5 mass %. The drying treatment was performed by spraying a jet of air having a temperature of 40° C. and a humidity of 20% RH. The dried toner particles were cooled to 24° C., and 100 parts by mass of the toner and 1 part by mass of a hydrophobic silica (whose average primary particle size was 14 nm) were mixed by a Henschel mixer. The mixing was performed for 20 minutes at a rotor blade circumferential speed of 24 m/s, and then a toner [3] was produced by the passage through a sieve having 400 MESH.

Production Example 4 of the Toner

A toner [4] was produced in the same manner as in the Production example 3 of the toner except that the amount of terephthalic acid added was changed to 55 parts by mass, the amount of isophthalic acid added was changed to 4 parts by mass and 41 parts by mass of fumaric acid was used instead of adipic acid. The glass transition temperature of the polyester resin produced was 45° C., and the weight-average molecular weight thereof was 33,000. Furthermore, the content of a dissociation acid monomer in the produced polyester resin was 50%.

Production Examples 1 to 4 of the Dry Developer

Each of the toners [1] to [4] and a ferrite carrier being coated with a silicone rein and having a volumetric average diameter of 60 nm were mixed, and dry developers [1] to [4] each having a toner concentration of 6 mass % were produced.

Preparative Example 1 of the Fixing Solution 2 parts by mass of a softening agent [1] shown in table 1, 1 part by mass of sorbitan monolaurate, and 97 parts by mass of ion exchange water were agitated for 5 minutes with an ultrasonic homogenizer, and a fixing solution [1] was obtained.

Preparative Examples 2 to 14 of the Fixing Solution

Fixing solutions [2] to [14] were prepared in the same manner as in the Preparative example 1 of the fixing solution except that the softening agent [1] was changed to each of softening agents [2] to [14] shown in table 1.

TABLE 1

| Fixing solution No. | Softening agent No. | In general formula (1) $R^{11}$ | $R^{12}$ | Position of OH group (with respect to carbonyl group) |
|---|---|---|---|---|
| [1] | [1] | $CH_2(OH)$ | $CH_3$ | α-OH |
| [2] | [2] | $CH_3CH(OH)$ | $CH_2CH_3$ | α-OH |
| [3] | [3] | $(CH_3)_2C(OH)$ | $CH_3$ | α-OH |
| [4] | [4] | $CH_3CH(OH)CH_2$ | $CH_2CH_3$ | β-OH |
| [5] | [5] | $CH_3CH_2CH(OH)CH_2$ | $CH_2CH_3$ | β-OH |
| [6] | [6] | $(OH)CH_2CH_2CH_2CH_2$ | $CH_2CH_3$ | δ-OH |
| [7] | [7] | $CH_3CH(OH)C(CH_3)(CH)CH_2$ | $CH_2CH_3$ | β-OH |
| [8] | [8] | $CH_3CH_2CH_2CH(OH)CH_2$ | $CH_2CH_3$ | β-OH |
| [9] | [9] | $CH_3CH_2CH_2CH_2CH(OH)CH_2$ | $CH_2CH_3$ | β-OH |
| [10] | [10] | $(CH_3)_3CCH(OH)CH_2$ | $CH_2CH_3$ | β-OH |
| [11] | [11] | $CH_3CH_2CH(CH_3)CH_2CH_2CH_2CH_2$ | $CH_2CH_S$ | β-OH |
| [12] | [12] | $CH_3(CH_2)_8CH(OH)CH_2$ | $CH_2CH_3$ | β-OH |
| [13] | [13] | $CH_3CH_2CH_2$ | $CH_2CH_3$ | Without OH |
| [14] | [14] | $CH_3(CH_2)_{10}CH(OH)CH_2$ | $CH_2CH_3$ | β-OH |

Preparative Example 15 of the Fixing Solution 2 parts by mass of a softening agent [15] shown in table 2, 1 part by mass of sorbitan monolaurate and 97 parts by mass of ion exchange water were agitated with an ultrasonic homogenizes for 5 minutes, and thus a fixing solution [15] was obtained.

Preparative Examples 16 to 24 of the Fixing Solution

Fixing solutions [16] to [24] were prepared in the same manner as in Example 15 of preparation of the fixing solution except that the softening agent [15] was changed to each of softening agents [16] to [24] shown in table 2.

TABLE 2

| Fixing solution No. | Softening agent No. | In general formula (2) $R^{21}$ | $R^{22}$ | $R^{23}$ | Position of OH group (with respect to carbonyl group) |
|---|---|---|---|---|---|
| [15] | [15] | $CH_3CH_2$ | $CH(OH)$ | $CH_2CH_3$ | α-α'OH |
| [16] | [16] | $CH_3CH_2$ | $CH(OH)CH_2$ | $CH_2CH_3$ | α-β'OH |
| [17] | [17] | $CH(CH_3)_2$ | $CH(OH)CH_2$ | $CH(CH_3)_2$ | α-β'OH |
| [18] | [18] | $CH_3CH_2$ | $CH(OH)CH_2CH_2$ | $CH_2CH_3$ | α-γ'OH |
| [19] | [19] | $CH_3CH_2$ | $CH_2CH(OH)CH_2$ | $CH_2CH_3$ | β-β'OH |
| [20] | [20] | $CH_3CH_2$ | $CH(OH)CH_2CH_2CH_2$ | $CH_2CH_3$ | α-δ'OH |
| [21] | [21] | $CH_3CH_2$ | $CH_2CH(OH)CH_2CH_2$ | $CH_2CH_3$ | β-γ'OH |
| [22] | [22] | $CH_3CH_2$ | $CH_2CH(OH)CH(OH)CH_2$ | $CH_2CH_3$ | β-β'OH*2 |
| [23] | [23] | $CH_3CH_2$ | $CH_2CH_2CH_2$ | $CH_2CH_3$ | Without OH |
| [24] | [24] | $CH_3CH_2$ | $CH_2CH(OH)(CH_2)_2$ | $CH_2CH_3$ | — |

Examples 1 to 26, Comparative Examples 1 to 4

The heating fixing unit of an image forming device "bizhub C 253" (manufactured by Konica Minolta Business Technologies, Inc.) was removed, a fixing unit [1] shown below was mounted, and the dry developer and the fixing solution were used in accordance with combinations thereof shown in table 3, with the result that a solid image was formed on an image support "J paper" (manufactured by Konica Minolta, Inc.) at a toner adhesion amount of 4 g/m$^2$. The following evaluation was performed on the obtained solid image. The results are shown in table 3. In this image formation, the fixing was performed without heating.

Fixing Unit [1]

The fixing unit [1] is configured with fixing solution supply means including a line-type inkjet nozzle as shown in FIG. 1.

The line-type inkjet nozzle constituting the fixing solution supply means has a resolution of 600 dpi and a liquid droplet size of 10 to 15 pl.

The set supply amount of fixing solution is 0.4 g/A4.

–Evaluation of a Wet Feeling After Chronological Leaving>

The formed solid image portion, a non-image portion and the solid image portion were stacked so as to face each other, a weight was placed such that the weight corresponds to 80 g/cm$^2$ with respect to the stacked portion, and they were left for 30 minutes in a constant temperature and humidity chamber maintained at 25° C. and at a humidity of 30%. The degree of image defects of the two stacked fixed images after being left is graded into 5 levels of "G1" to "G5" shown below. Note that the levels of G3 or more are levels in which there is no problem in practical use.

G1: Since the image portions adhere to each other, paper itself to which the images are fixed peels off, image defects are intense, and it can be obviously seen that the image is shifted to the non-image portion.

G2: Since the images adhere to each other, white spots being image defects are generated in some parts of the image portions.

G3: When the two stacked images are separated, although image roughness and gloss decrease are generated, on the fixing surfaces thereof, there are almost no image defects, and even image defects present are allowable. The image is found to be slightly shifted to the non-image portion.

G4: When the two stacked images are separated, although the crack sound is made and the image is found to be slightly shifted to the non-image portion, there are no image defects without any problem at all.

G5: There are no image defects and image shift at all both in the image portions and non-image portion.

<Rubbing Fixing Rate>

Five seconds after the fixing, the surface of the solid image was rubbed with a piece of cotton cloth having a diameter of 1 cm, and the reflected density thereof was measured before and after the rubbing with "RD-918" manufactured by Macbeth Co., Ltd), Through the use of the following formula (1), the rubbing fixing rate was calculated, and evaluation was performed on the basis of the following evaluation criteria. When the rubbing fixing rate is 70% or more, there is no problem in practical use.

rubbing fixing rate (%)={reflected density after rubbing/reflected density before rubbing (1.40)}×100 Formula (1):

<Variations in the Amount of the Fixing Solution to the Fixing Strength>

The rubbing fixing rates for 25% or less of the initial set supply amount of fixing solution of 0.4 g/A4, 25 to 50% thereof, 50 to 75% thereof and 100% thereof were determined under the same conditions of formula (1) described above. The amount of fixing solution when the rubbing fixing rate is 80% was evaluated by using the following evaluation criteria. Note that the rank "C" or higher ranks are defined as acceptable levels.

A (Excellent): the amount of less than 25% of fixing solution

B (Good): the amount of 25% or more to less than 50% of fixing solution

C (Practicable): the amount of 50% or more to less than 75% of fixing solution

D (Unacceptable): the amount of 75% or more of fixing solution

TABLE 3

| | Dry developer No. | Fixing solution No. | Degree of image defects Wet feeling (rank) | Rubbing fixing rate (%) | Variations in the amount of fixing solution: The amount of fixing solution when the rubbing fixing rate is 80% (with respect to the initial set amount %) | Variations in the amount of fixing solution: Rank |
|---|---|---|---|---|---|---|
| Example 1 | [1] | [1] | G3 | 72 | 64 | C |
| Example 2 | | [2] | G3 | 75 | 60 | C |
| Example 3 | | [3] | G3 | 80 | 50 | C |
| Example 4 | | [4] | G4 | 85 | 35 | B |
| Example 5 | | [5] | G4 | 87 | 30 | B |
| Example 6 | | [6] | G3 | 82 | 45 | B |
| Example 7 | | [7] | G4 | 88 | 30 | B |
| Example 8 | | [8] | G5 | 92 | 10 | A |
| Example 9 | | [9] | G5 | 90 | 13 | A |
| Example 10 | | [10] | G5 | 90 | 15 | A |
| Example 11 | | [11] | G4 | 85 | 30 | B |
| Example 12 | | [12] | G4 | 85 | 25 | B |
| Example 13 | [2] | [8] | G5 | 90 | 10 | A |
| Example 14 | [3] | [1] | G3 | 75 | 55 | C |
| Example 15 | | [2] | G3 | 75 | 58 | C |
| Example 16 | | [3] | G3 | 81 | 40 | B |
| Example 17 | | [4] | G4 | 85 | 35 | B |
| Example 18 | | [5] | G4 | 87 | 30 | B |
| Example 19 | | [6] | G3 | 80 | 50 | C |
| Example 20 | | [7] | G4 | 85 | 35 | B |
| Example 21 | | [8] | G5 | 90 | 8 | A |
| Example 22 | | [9] | G5 | 90 | 10 | A |
| Example 23 | | [10] | G5 | 88 | 20 | A |
| Example 24 | | [11] | G4 | 83 | 40 | B |
| Example 25 | | [12] | G4 | 85 | 35 | B |
| Example 26 | [4] | [8] | G5 | 91 | 9 | A |
| Comparative example 1 | [1] | [13] | G1 | 55 | 90 | D |
| Comparative example 2 | [1] | [14] | G2 | 60 | 80 | D |
| Comparative example 3 | [3] | [13] | G1 | 61 | 82 | D |
| Comparative example 4 | [3] | [14] | G2 | 57 | 85 | D |

As shown in the results of table 3, examples 1 to 26, as compared with comparative examples 1 to 4, are recognized to be excellent in the wet feeling after chronological leaving, the rubbing fixing rate and the variations in amount of the fixing solution to the fixing strength.

Examples 27 to 44, Comparative Examples 5 to 8

Like in examples 1 to 26, the heating fixing unit of the image forming device "bizhub C 253" (manufactured by Konica Minolta Business Technologies, Inc.) was removed, the fixing unit [1] shown above was mounted, and the dry developer and the fixing solution were used in accordance with combinations thereof shown in table 4, with the result that a solid image was formed on the image support "J paper" (manufactured by Konica Minolta, Inc.) at a toner adhesion amount of 4 g/m$^2$. The following evaluation was performed on the obtained solid image. The results are shown in table 4. In this image formation, the fixing was performed without heating.

<Evaluation of a Wet Feeling When Being Left Over Time>

Evaluation was performed under the same conditions and criteria as in examples 1 to 26 and comparative examples 1 to 4.

<Rubbing Fixing Rate>

Evaluation was performed under the same conditions and criteria as in examples 1 to 26 and comparative examples 1 to 4.

TABLE 4

| | Dry developer No. | Fixing solution No. | Degree of image defects Wet feeling (rank) | Rubbing fixing rate (%) |
|---|---|---|---|---|
| Example 27 | [1] | [15] | G3 | 72 |
| Example 28 | | [16] | G4 | 83 |
| Example 29 | | [17] | G3 | 78 |
| Example 30 | | [18] | G4 | 85 |
| Example 31 | | [19] | G5 | 90 |
| Example 32 | | [20] | G4 | 82 |
| Example 33 | | [21] | G4 | 85 |
| Example 34 | | [22] | G5 | 88 |
| Example 35 | [2] | [19] | G5 | 90 |
| Example 36 | [3] | [15] | G3 | 75 |
| Example 37 | | [16] | G4 | 83 |
| Example 38 | | [17] | G3 | 81 |
| Example 39 | | [18] | G4 | 85 |
| Example 40 | | [19] | G5 | 92 |
| Example 41 | | [20] | G4 | 85 |
| Example 42 | | [21] | G4 | 88 |
| Example 43 | | [22] | G5 | 90 |
| Example 44 | [4] | [19] | G5 | 94 |
| Comparative example 5 | [1] | [23] | G1 | 55 |
| Comparative example 6 | [1] | [24] | G2 | 60 |
| Comparative example 7 | [3] | [23] | G1 | 61 |
| Comparative example 8 | [3] | [24] | G2 | 57 |

As shown in the results of table 4, examples 27 to 44, as compared with comparative examples 5 to 8, are recognized to be excellent in the wet feeling after chronological leaving and the rubbing fixing rate.

Description of the Symbols

10 image forming device
20 intermediate transfer body
21A, 21B, 21C support roller
30Y, 30M, 30C, 30K image formation unit
31 toner image carrier
31Y, 31M, 31C, 31K photoreceptor
32Y, 32M, 32C, 32K charging means
33Y, 33M, 33C, 33K exposure means
34Y, 34M, 34C, 34K developing means
35Y, 35M, 35C, 35K primary transfer means
36Y, 36M, 36C, 36K cleaning means
40 secondary transfer means
50, 50A, 50B, 50C, 50D fixing solution supply means
51 fixing solution coating roller
52 pressurizing roller
53 metalling blade
54 foam generation device
55 fixing solution coating roller
56 pressurizing roller
57 regulation blade
60 cleaning means
70 pressure application means
B foamed film
F fixing solution
M liquid film
T toner image
P image support

What is claimed is:

1. An image forming method comprising:

an electrostatic latent image formation step of forming an electrostatic latent image on an electrostatic latent image carrier;

a development step of forming a toner image by developing the electrostatic latent image with a dry developer including a toner;

a transfer step of transferring the toner image to an image support; and a fixing solution supply step of supplying, to the toner image transferred to the image support, a fixing solution that softens the toner, wherein the fixing solution contains an ester compound represented by at least one of general formula (1) and general formula (2) below:

$$R^{11}—(CO)—O—R^{12} \quad \text{general formula (1):}$$

where $R^{11}$ represents a linear or branched alkyl group having at least one hydroxyl group and 2 to 11 carbon atoms, and $R^{12}$ represents a linear or branched alkyl group having 1 to 4 carbon atoms;

$$R^{21}—O—(CO)—R^{22}—(CO)—O—R^{23} \quad \text{general formula (2):}$$

where $R^{21}$ represents a linear or branched aliphatic hydrocarbon group having 1 to 4 carbon atoms, $R^{22}$ represents a linear or branched aliphatic hydrocarbon group having at least one hydroxyl group and 1 to 8 carbon atoms, and $R^{23}$ represents a linear or branched aliphatic hydrocarbon group having 1 to 4 carbon atoms.

2. The image forming method according to claim 1, wherein the ester compound represented by the general formula (1) is at least one selected from ethyl lactate, isoamyl lactate, 3-hydroxybutyric acid ethyl ester, 2-hydroxybutyric acid ethyl ester, 2-hydroxyisobutyric acid methyl ester, 3-hydroxyvaleric acid ethyl ester, 2-hydroxyvaleric acid ethyl ester, 2-hydroxy-4-metyl valeric acid ethyl ester, 3-hydroxyhexane acid ethyl ester, 2-hydroxyhexane acid ethyl ester, 5-hydroxyhexane acid ethyl ester, 3-hydroxyoctanoic acid ethyl ester and 5-hydroxyoctanoic acid ethyl ester.

3. The image forming method according to claim 2, wherein the ester compound represented by the general formula (1) has, in $R^{11}$ of the general formula (1), a hydroxyl group at β position to a carbonyl group.

4. The image forming method according to claim 3, wherein the ester compound represented by the general formula (1) is 3-hydroxyhexane acid ethyl ester.

5. The image forming method according to claim 1, wherein the ester compound represented by the general formula (2) is at least one selected from 2-hydroxy malonic acid diethyl ester, 2-hydroxy malonic acid diisopropyl ester, diethyl malate (2-hydroxy succinic acid diethyl ester), dibutyl malate (2-hydroxy succinic acid dibutyl ester), 3-hydroxy glutaric acid diethyl ester (3-hydroxy pentanedioic acid diethyl ester), 2-hydroxy glutaric acid diethyl ester (2-hydroxy pentanedioic acid diethyl ester), 2-hydroxy adipic acid diethyl ester (2-hydroxy hexanedioic acid diethyl ester), 3-hydroxy adipic acid diethyl ester (3-hydroxy hexanedioic acid diethyl ester), 2-hydroxy octanedioic acid diethyl ester and 3-hydroxy octanedioic acid diethyl ester.

6. The image forming method according to claim 5, wherein the ester compound represented by the general formula (2) has, in $R^{22}$ of the general formula (2), a hydroxyl group at β position to a carbonyl group.

7. The image forming method according to claim 6, wherein the ester compound represented by the general formula (2) is 3-hydroxy glutaric acid diethyl ester.

8. The image forming method according to claim 1, wherein the fixing solution further contains a diluent and a surfactant.

9. The image forming method according to claim 8, wherein a content of the surfactant is 1 to 5 mass % relative to the fixing solution.

10. The image forming method, according to claim 1, wherein the ester compound represented by at least one of the general formula (1) and the general formula (2) is contained at a rate of 1 to 30 mass % to the fixing solution.

11. The image forming method according to claim 1, wherein the toner includes toner particles containing a polyester resin as a binder resin.

12. The image forming method according to claim 1, wherein a particle diameter of the toner is 3.5 to 7.0 μm as a volume-based median diameter.

13. The image forming method according to claim 12, wherein a particle diameter of the toner is 5.0 to 6.5 μm as a volume-based median diameter.

14. The image forming method according to claim 1, wherein an average degree of circularity of the toner is 0.950 to 0.995.

15. The image forming method according to claim 1, wherein a glass transition temperature of the toner is 35 to 50° C.

16. The image forming method according to claim 1, wherein a supply amount of the fixing solution is 0.4 g or less per image support of A4-size.

17. The image forming method according to claim 16, wherein a supply amount of the fixing solution is 0.1 g or less per image support of A4-size.

18. The image forming method according to claim 1, wherein, as a method of supplying the fixing solution, fixing solution supply means including a line-type inkjet nozzle is used.

19. The image forming method according to claim 18, wherein a size of a droplet of the fixing solution discharged from the inkjet nozzle is 0.5 to 50 pl.

* * * * *